US006629803B1

(12) United States Patent
McFarland

(10) Patent No.: US 6,629,803 B1
(45) Date of Patent: Oct. 7, 2003

(54) WAVE FORMING APPARATUS AND METHOD

(76) Inventor: Bruce C. McFarland, 615 Marvista Dr., Solana Beach, CA (US) 92075

( * ) Notice: Subject to any disclaimer, the term of this patent is extended or adjusted under 35 U.S.C. 154(b) by 0 days.

(21) Appl. No.: 10/103,600

(22) Filed: Mar. 19, 2002

(51) Int. Cl.[7] ..... E02B 3/00
(52) U.S. Cl. ..... 405/79; 472/117
(58) Field of Search ..... 405/79, 76; 4/491; 472/117, 128

(56) References Cited

U.S. PATENT DOCUMENTS

| | | | | |
|---|---|---|---|---|
| 3,350,724 | A | 11/1967 | Leigh | |
| 3,802,697 | A | 4/1974 | Le Mehaute | |
| 3,913,332 | A | 10/1975 | Forsman | |
| 4,142,258 | A | 3/1979 | Schiron | |
| 4,954,014 | A | 9/1990 | Sauerbier et al. | |
| 5,171,101 | A | 12/1992 | Sauerbier et al. | |
| 5,271,692 | A | 12/1993 | Lochtefeld | |
| 5,342,145 | A | 8/1994 | Cohen | |
| 5,421,782 | A | 6/1995 | Lochtefeld | |
| 5,564,859 | A | 10/1996 | Lochtefeld | |
| 5,667,445 | A | 9/1997 | Lochtefeld | |
| 5,913,636 | A | 6/1999 | Macaulay | |
| 6,019,547 | A | 2/2000 | Hill | |
| 6,132,317 | A | 10/2000 | Lochtefeld | |
| 6,336,771 | B1 | 1/2002 | Hill | |
| 6,491,589 | B1 * | 12/2002 | Lochtefeld | 472/117 |
| 2002/0056157 | A1 | 5/2002 | Lochtefeld | |

OTHER PUBLICATIONS

N. Rajarantnam, Hydraulic Jumps. In: Advances in Hydro–science, V.T. Chow, wed., vol. 1–4, Academic Press, New York, NY pp. 198–280.

* cited by examiner

*Primary Examiner*—Heather Shackelford
*Assistant Examiner*—Lisa M. Saldano
(74) *Attorney, Agent, or Firm*—Brown, Martin, Haller & McClain LLP

(57) ABSTRACT

A wave forming apparatus has a channel for containing a flow of water with an inlet end connected to a water supply, a base, and spaced side walls, a weir in the base at the inlet end of the channel, and at least one bed form in the channel downstream of the weir. The bed form has an upwardly inclined upstream face extending downstream of the leading end, an upper portion, and a downwardly inclined downstream face extending from the upper portion to the trailing end. A primary flow path for water extends over the weir and bed form. A secondary flow passageway extends through the bed form, with a first end adjacent the trailing end of the bed form, and a second end in the bed form upstream of the first end.

37 Claims, 6 Drawing Sheets

WAVE FORMING APPARATUS AND METHOD

BACKGROUND OF THE INVENTION

The present invention relates generally to a wave forming apparatus and is partially concerned with water rides of the type provided in water-based amusement parks, particularly a wave forming apparatus and method for forming surfable waves, or a water toy.

Naturally occurring waves occur in the ocean and also in rivers. These waves are of various types, such as moving waves which may be of various shapes, including tubular and other breaking waves. A relatively rare type of wave in nature is the standing wave, which has a steep, unbroken and stable wave face. This type of wave can have enough power and velocity to support surfing on the wave face without causing the wave to decay rapidly. This wave, if forced to decay, for example by overly obstructing the flow, reforms naturally when the obstructions are removed. Natural standing waves have been shown to occur where water flows across natural river bed formations, known as anti-dunes. Upon flow over anti-dunes, the water flow rises into a natural standing wave. Natural standing waves occur in the Waimea Bay river mouth of the Waimea River on the Hawaiian island of Oahu, on the Snake River in Wyoming, and several other places.

Surfers are constantly searching for good surfing waves, such as tubular breaking waves and standing waves. There are only a few locations in the world where such waves are formed naturally on a consistent basis. Thus, there have been many attempts in the past to create artificial waves of various types for surfing in controlled environments such as water parks. In some cases, a sheet flow of water is directed over an inclined surface of the desired wave shape. Therefore, rather than creating a stand-alone wave in the water, the inclined surface defines the wave shape and the rider surfs on a thin sheet of water flowing over the surface. This type of apparatus is described, for example, in U.S. Pat. Nos. 5,564,859 and 6,132,317 of Lochtefeld. In some cases, the inclined surface is shaped to cause a tubular form wave. Sheet flow wave simulating devices have some disadvantages. For example, since these systems create a fast moving, thin sheet of water, they produce a different surfing experience to a real standing wave.

In other prior art wave forming devices, a wave is actually simulated in the water itself, rather than being defined by a surface over which a thin sheet of water flows. U.S. Pat. No. 6,019,547 of Hill describes a wave forming apparatus which attempts to simulate natural anti-dune formations in order to create waves. A water-shaping airfoil is disposed within a flume containing a flow of water, and a wave-forming ramp is positioned downstream of the airfoil structure. In other prior art arrangements, such as U.S. Pat. No. 3,913,332 of Forsman, a wave generator is driven around a circular body of water in order to create waves. This arrangement is also complex and will produce traveling waves, not standing waves.

SUMMARY OF THE INVENTION

It is an object of the present invention to provide a new and improved wave forming apparatus and method.

According to one aspect of the present invention, a wave forming apparatus is provided, which comprises a channel for containing a flow of water, the channel having an inlet end connected to a water supply, a base, and spaced side walls, a weir in the base at the inlet end of the channel, and at least one bed form in the channel downstream of the weir, the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form, and a secondary flow passageway provided in the channel, the secondary flow passageway having a first end communicating with the primary water flow at a location adjacent the trailing end of the bed form, and a second end communicating with the primary water flow at a location upstream of the first end.

In an exemplary embodiment of the invention, the first end of the secondary flow passageway comprises a first vent extending across the full width of the bed form. The second end may comprise a second vent extending across the full width of the bed form, or may comprise spaced second vents adjacent opposite sides of the bed form, each vent extending across the upper portion of the bed form. The first and second vents may be connected together via ducting or passageways through the bed form. Alternatively, the bed form may comprise a hollow shell so that the vents communicate via the chamber within the hollow shell.

This arrangement will tend to create a standing wave at the leading end of the bed form and any subsequent bed form. The provision of a secondary flow channel within the bed form communicating with a vent at the trailing edge of the bed form will enhance production of a stable standing wave at the next bed form in the channel, where two or more successive bed forms are provided. A secondary flow passageway may also be provided in the weir. In the exemplary embodiment, the side walls of the channel do not extend vertically upwardly from the top of the bed forms, but instead have outwardly angled, shallow inclined portions which taper slowly upwardly from the opposite sides of the weir and bed forms. Alternatively, the side portions on opposite sides of the channel extend outwardly either horizontally or at a slightly downwardly inclined angle on opposite sides of the channel containing the bed forms. In practice, the outer side portions or side walls may extend outwardly from the channel at an angle relative to the horizontal of +10° to −5°. This has been found to enhance the standing wave formation capabilities of the apparatus, and also provides a shallow lead-in portion for individuals prior to riding a standing wave, and for exiting the ride.

Water flows along the secondary flow passageway in either direction, depending on the conditions. It has been found that the provision of the secondary flow path enhances the formation of a stable standing wave at the upstream face of the bed form, and at any other bed forms downstream of the first bed form. Thus, additional secondary flow passageways will be provided, one for each wave-forming bed form. Adjustable valves or the like may be provided in the secondary flow passageways in order to vary the secondary flow rate. Additionally, several separate gates may be provided across the width of the first vent or the flow passageway, and these gates, if closed sequentially, can produce a lateral breaking wave.

In an exemplary embodiment of the invention, the trailing end of the bed form has an abrupt vertical drop off, such that the uppermost region of the trailing end is raised up above the channel bottom by a predetermined tail elevation. This has been found to enhance the standing wave formation properties of the apparatus. In fact, with an abrupt trailing end drop off in the waveform in a predetermined elevation range, the secondary passageways may be eliminated altogether, and standing waves may still be created. The tail elevation factor (TEF), or ratio of the top surface distance at the trailing end of the bed form above the channel bottom to the elevation of the top or peak of the next bed form above the channel bottom, may be in the range from 0.125 to 0.75 while still producing a rideable standing wave. Waves will still be produced at ratios above 0.75.

The tail elevation need not be constant across the entire width of the bed form. For example, TEF may be zero at one side of the channel and 0.8 at the other side. The tail elevation may be permitted to self-adjust based on water pressure. This will produce an oscillating wave.

In an exemplary embodiment of the invention, a series of identical bed forms are provided at spaced intervals along the channel, so that a series of standing waves may be formed. The channel cross section may be deeper in the wave forming area than at the outer sides of the bed forms, and may have gradually outwardly sloping side walls. This tends to return water to the center of the flume or channel, and also prevents too much water from escaping around the sides of the bed forms.

According to another aspect of the present invention, a method of forming waves is provided, which comprises the steps of directing water from a reservoir at one end of a channel having a base and spaced side walls into the channel and over a weir at the inlet end of the channel, directing water in the channel in a primary flow path over at least one bed form in the channel downstream of the weir, the bed form having a leading end and a trailing end, an upwardly inclined upstream face extending downstream of the leading end, an upper portion, and a downwardly inclined downstream face extending from the upper portion to the trailing end, and directing a secondary flow of water along a secondary flow passageway having a first end communicating with the primary water flow at a location adjacent the trailing end of the bed form, and a second end communicating with the primary water flow at a location upstream of the first end, whereby a stable standing wave is formed downstream of the bed form.

This invention provides a wave generating apparatus and method particularly suitable for use in water park rides and the like which is able to produce more consistent and controllable standing waves than was possible in the past. The waves will be of good quality, enabling surfers to ride for a longer period of time without the wave decaying.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
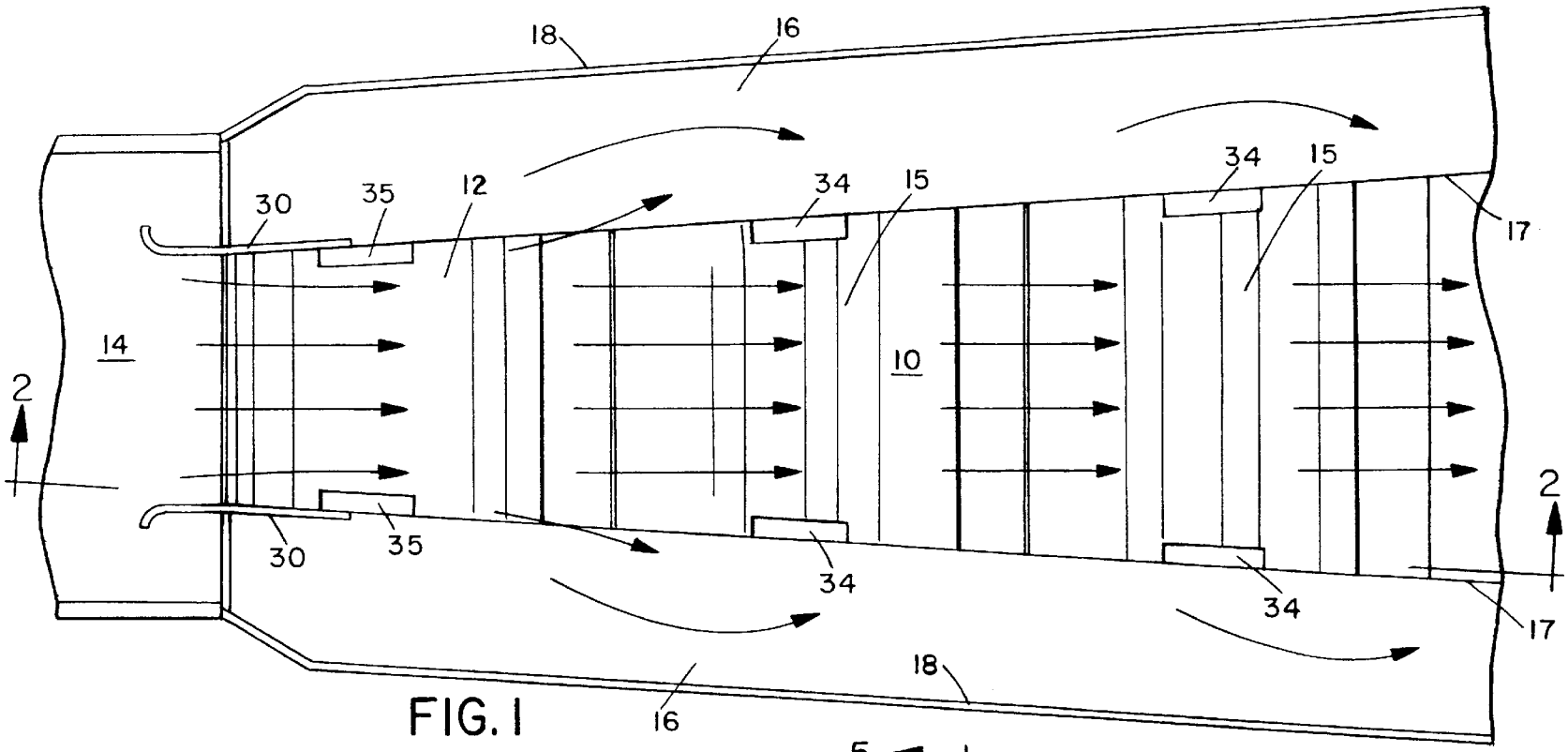
FIG. 1 is a top plan view of a wave forming apparatus according to a first exemplary embodiment of the invention.
Figure 2:
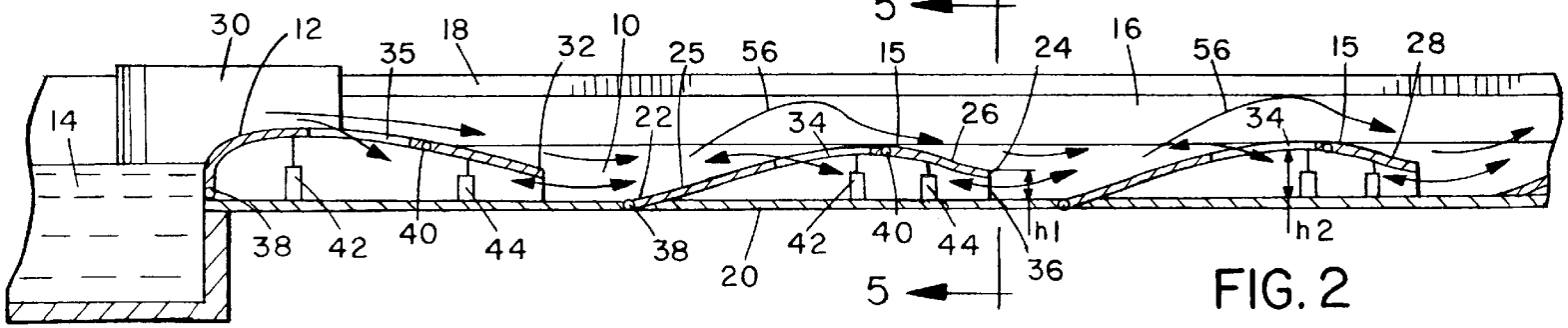
FIG. 2 is a sectional view taken along lines 2—2 of FIG. 1, showing the basic water flow.
Figure 5:
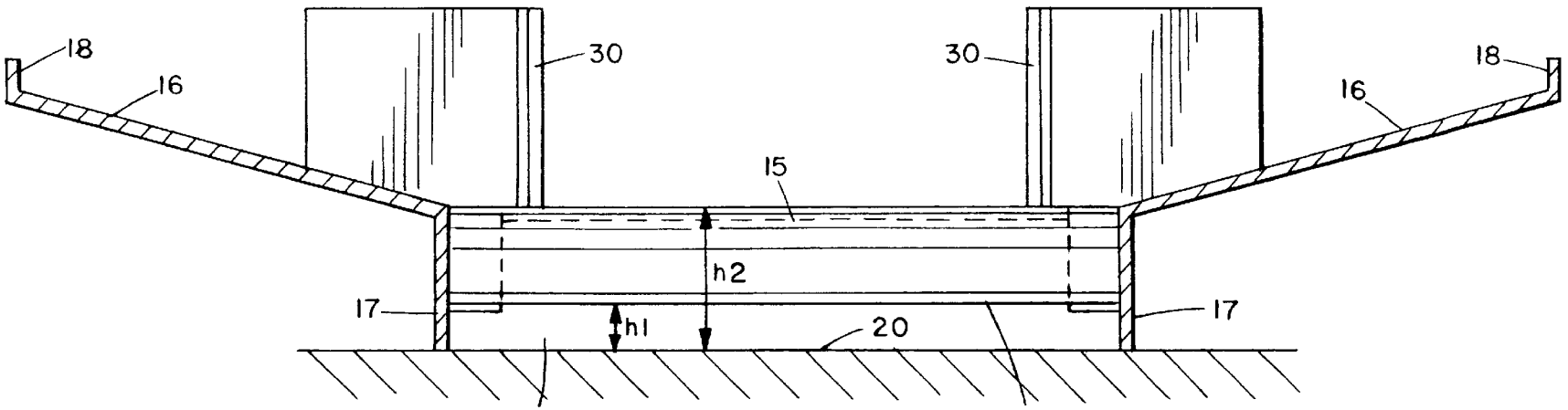
FIG. 5 is an enlarged sectional view taken on lines 5—5 of FIG. 2.

FIGS. 1, 2 and 5 illustrate a wave forming apparatus according to a first embodiment of the invention for forming rideable, standing waves. The apparatus basically comprises a channel 10 for containing a flow of water, the channel having a weir 12 at its inlet end connected to a supply of water in a reservoir 14, and a series of spaced bed forms 15 in the channel downstream of the weir. Sloping side walls or entry/exit portions 16 extend outwardly from opposite sides 17 of the wave forming channel 10 to the outer sides 18 of the apparatus, which are spaced outwardly from the outer sides of channel 10, as best illustrated in FIGS. 1 and 5.

As best illustrated in FIG. 2, the channel 10 has a base or lower wall 20 and the weir 12 and bed forms 15 are provided at spaced intervals along the channel, mounted in the base of the channel and extending between the opposite side walls of the channel, to define a primary flow path for water over the weir and the bed forms. In the embodiment of FIGS. 1, 2 and 5, the opposite sides 17 of the channel 10 are shown to taper outwardly from the inlet end of the channel, at weir 12, to the opposite end of the channel. However, the sides 17 may alternatively be straight, as in the embodiment of FIGS. 15 and 16, discussed in more detail below, or taper The bed forms 15 are each of similar or identical shape and have a leading end 22 and a trailing end 24, with an upstream face 25 inclined upwardly to a peak, and a downstream face 26 with a downwardly inclined, convex curvature extending from the peak towards the trailing end 24. As best illustrated in FIG. 2, the upstream end 22 is flush with the base 20 of the channel, for improved safety. The downstream face has a re-curve or change in curvature adjacent the trailing end, such that it terminates in a generally flat or horizontal portion 28. The trailing end 24 is spaced above the base 20 of the channel to form an abrupt vertical cut-off, as indicated in FIG. 2. The tail elevation factor TEF, or ratio of the height h1 of the trailing end 24 of the bed form above the base of the channel to the height h2 at the top or peak of the next bed form is designed to be in a predetermined range which has been found to produce standing waves. The range in TEF may be in the range from 0.125 to 0.75 while still producing rideable standing waves.

The weir 12 also extends upwardly from the base, with a trailing end at the inlet from reservoir 14. Spaced inlet side walls 30 extend from a location in reservoir 14 outwardly along opposite sides of weir 12. This has been found to smooth the water flow from the reservoir into the channel 10. The weir 12 is of an airfoil like shape, extending upwardly from the leading edge to a peak and then having a convex downward curvature up to trailing edge 32, which is also spaced above the base 20 of the channel.

In the embodiment of FIG. 2, the weir and bed forms 12 and 15 may be of any suitable sheet material construction, such as metal, strong plastic material, or thin concrete and have a hollow interior. The bed forms each have a pair of elongate side vents 34 along opposite sides of the bed form extending across the peak of the bed form, as best illustrated in FIGS. 1 and 2. Similarly, the weir 12 has a pair of elongate side vents 35 on its opposite sides, extending along part of the downwardly inclined face. The raised trailing ends of the weir and bed forms also each form a vent 36 extending across the width of the channel, which defines, together with side vents 34, a secondary flow path for water traveling along channel 10.

The weir and bed form may each be supported by pedestals under or adjacent the peak or highest point of the bed form, such as pedestals 42 as illustrated in FIG. 2. Shorter pedestals 44 are provided to support the tail end portion of the weir and bed forms. The pedestals 42 and 44 are adjustable in height, with the opposite sides of the weir and bed forms sliding against the channel side walls 17. In an exemplary embodiment, two spaced pedestals 42 and two spaced pedestals 44 are provided, with each pedestal being approximately one quarter of the bed form width inwardly from the adjacent side wall 17, and spaced apart from the other pedestal by a distance equal to half the bed form width. A greater number of pedestals may be provided if required for additional support.

In order to provide adjustability in the secondary flow, the adjustable pedestals or hydraulic rams 42 and 44 provide height adjusters for varying the bedform and tail elevation. In the illustrated embodiment, the weir and bed forms are each secured to the channel base at the leading end via a first pivot 38, and a trailing end portion of the weir and bed forms is formed as a separate section pivoted to the remainder at a second pivot 40. The first pedestal or hydraulic ram 42 acts between the base of the channel and the upstream pivoted portion of the weir and bed form, and the second pedestal or hydraulic ram 44 acts between the base of the channel and the pivoted trailing end portion of the weir and bed forms. The first height adjuster 42 will change the height of the peak of the weir or bed form, while the second height adjuster will change the elevation of the tail end of the weir or bed form, thus changing the vent height and the amount of secondary flow into or out of the tail end vent. The two pedestals can therefore be adjusted to vary the TEF ratio.

Figure 8:
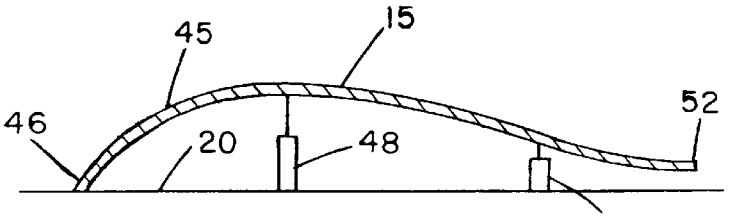
FIG. 8 is a sectional view illustrating another modified bed form with vent height adjustability.
Figure 9:
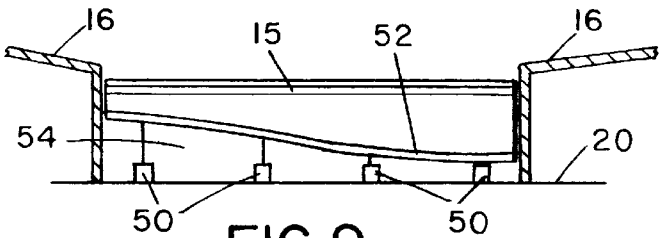
FIG. 9 is an end view of the bed form of FIG. 8, illustrating the height adjusters across the width of the vent.

FIGS. 8 and 9 illustrate a modified height adjustment mechanism for a bed form 15. In this case, rather than pivoted sections, each bed form is a hollow shell 45 formed from a flexible material and secured to the base 20 of the channel at the leading end 46 only. A first series of spaced height adjusters or hydraulic rams 48 extend at spaced intervals across the channel between the base of the channel and the inner surface of the shell 45 adjacent the peak of the bed form. A second series of spaced height adjusters or hydraulic rams 50 extend at spaced intervals across the width of the bed form adjacent the trailing end 52. Thus, the height adjusters 50 can be extended by different amounts, as in FIG. 9, in order to vary the height of the secondary passageway vent 54 across the width of the channel, to vary the standing wave properties. Useful waves can be created with different elevations across the width fo the tail, for example one side may be at TEF=0 and the other side at TEF=0.8. This will still create a rideable wave. If the rams 50 are eliminated, the tail end of the bed form in FIG. 8 will be self-adjusting in height. This will create an oscillating wave which may be desirable in some cases.

Although the embodiments of FIGS. 1,2 and 5 and FIGS. 8 and 9 have both weirs and bed forms with height adjustment devices, it will be understood that the apparatus may alternatively have fixed weirs, without any height adjusters, combined with adjustable bed forms, or may have both fixed weirs and fixed bed forms of the same general shape illustrated in the drawings. The adjustability is provided as a means for the operator to vary the wave conditions as desired. However, this may not be necessary in all cases.

In the apparatus illustrated in FIGS. 1,2 and 5 and the alternative of FIGS. 8 and 9, water will flow from the reservoir in a primary flow path over the top of weir 12 and over each of the successive bed forms. At the same time, as indicated by the arrows 55, a secondary flow path is provided via the side vents and trailing end vents of the weir and bed forms. This secondary flow may be in either direction, i.e. from the trailing end back under the bed form and out at the peak of the bed form, or vice versa, depending on overall flow conditions. The provision of a secondary flow passageway through the bed form with a vent at the trailing edge of the bed form has been found to produce a stable standing wave 56 at the upstream face of the next bed form in the channel, as indicated in FIG. 2. The standing wave formation is enhanced by the provision of the shallow sloping side wall portions 16, which provide for some flow outside channel 10, as indicated in FIG. 1. In general, it is desirable that the flume be deeper in the channel or wave forming area 10 that contains the bed forms, and shallower just beyond the sides of the bed forms. This channels the water over the bed forms, and prevents too much water from escaping around the bed forms, while allowing the sides of the top portion of the standing wave to vent sideways. This is believed to help prevent the standing wave from decaying. The slight upward inclination out to the opposite sides 18 of the apparatus also helps to return water towards the center of the channel, helping additional wave formation at subsequent downstream bed forms.

Figure 17:
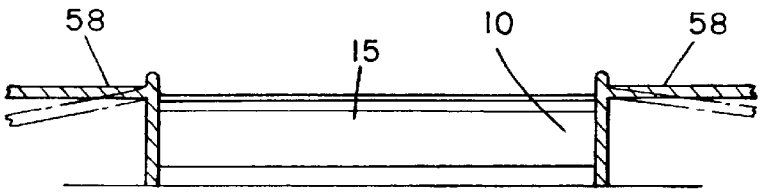
FIG. 17 is a sectional view similar to FIG. 5, but on a reduced scale, illustrating alternative side portions at opposite sides of the wave forming channel.

Although the opposite side portions 16 extending from opposite sides of the channel 10 and bed forms out to the outer sides 18 of the wave forming apparatus are shown in FIG. 5 as having a slight upward slope, they may alternatively be flat or even have a slight downward slope, as indicated in FIG. 17. FIG. 17 is a view similar to FIG. 5 of a modified flume structure in which flat, shallow outer side portions 58 are provided on opposite sides of the channel. The side portions 58 may alternatively be inclined slightly downwardly, as indicated in dotted outline. It has been found that the side portions 16 or 58 may have an inclination in the range from −5° up to +10°. Any angle in this range will have the desired effect of standing wave formation, although an inclination above 0° has the advantage of returning water back into the channel downstream of a first standing wave. Each side portion 16, 58 will have a width equal to at least 33% of the channel width for optimum wave sustaining effect. If the side portions are of different widths, one side may have a width of 25% of the channel width if the other side is wider.

The reservoir 14 will be continuously supplied with water via a suitable water-re-circulating system of a type well known in the field of water park rides, in which water leaving the end of channel 10 is pumped back into the reservoir. The water re-circulation path may be beneath the channel 10, around one or both sides of the channel, or from other adjacent, linked rides.

The combination of features in FIG. 2, i.e. the specific bed form shape, the secondary passageways, and the shallow outer side portions 16, has been found on testing to lead to stable standing wave formation. This, in turn, will produce a wave riding water ride suitable for a water amusement park. The shallow outer side portions 16 also provide a convenient means for a rider to enter and exit the ride. It will be understood that the side vents 34,35 and end vents 36 will be covered with gratings (not illustrated) for rider safety. The standing wave 56 will have a steep, unbroken, and stable wave face which is ideal for surfing. Variation of the trailing end vent height across the width of the bed form, as in FIG. 9, may be used, if desired, to create effects such as a sideways breaking wave. The height adjusters 42,44 may be adjusted to produce a desired sequence of standing, stable waves.

Figure 3:
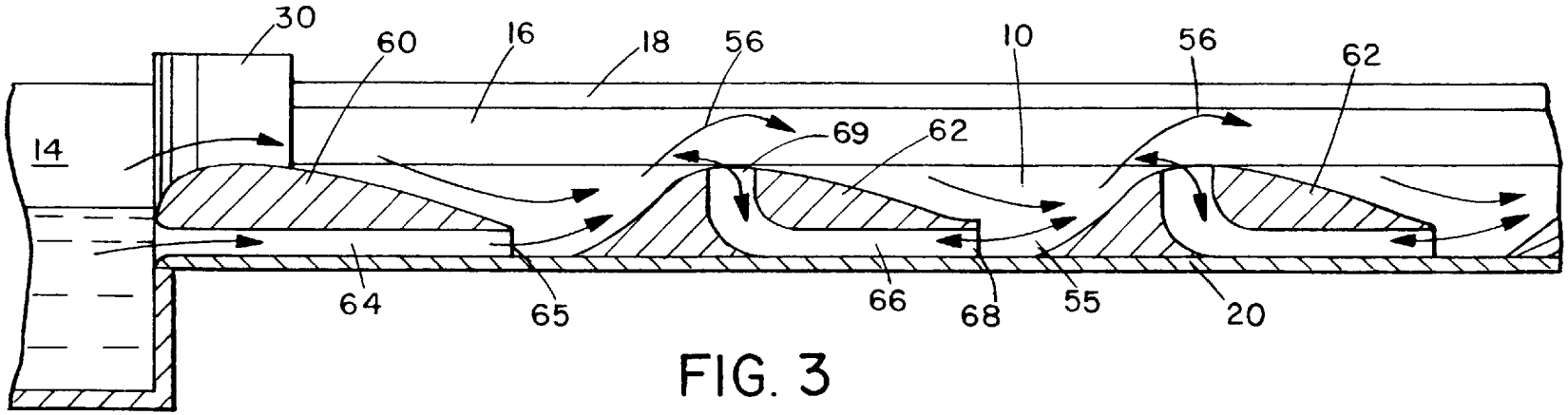
FIG. 3 is a sectional view similar to FIG. 2, showing a modified apparatus.

The weir and bed forms of FIGS. 2 and 8 are hollow shells which provide the secondary passageways back under the shell via suitable venting. Although the vents 34,35 are spaced side vents in the illustrated embodiment, a vent extending across the top of the bed form may alternatively be provided. However, side vents will normally be preferable since this avoids the need for a safety grating across the entire top of the bed form. Additionally, instead of forming the weir and bed forms by separate shaped sheet-like members secured in the channel, they may alternatively be formed or molded integrally in the base of the channel as solid structures. FIG. 3 illustrates a modified wave forming apparatus according to another embodiment of the invention, in which the hollow shell weir and bed forms are replaced with a solid weir 60 and solid bed forms 62 spaced downstream of weir 60. The remainder of the apparatus, apart from the weir and bed forms, is identical to that of FIGS. 1 and 2, and like reference numerals have been used for like parts as appropriate.

The weir 60 is of identical surface shape to the hollow weir 12 of FIG. 2, but has a passageway 64 extending under the weir from the leading end to the trailing end 65, instead of the vent structure of FIG. 2. The bed forms 62 are also of identical shape to the bed forms 15 of FIG. 1, but the vent openings 34,36 are replaced with passageways 66 through the bed forms. Each passageway 66 has one end opening 68 at the trailing end of the bed form, and another end opening 69 adjacent the peak of the bed form. Two openings 69 may be provided on opposite sides of bed form 62, with two spaced passageways 66 ending in a chamber extending across the width of the bed form and terminating at opening 68. Alternatively, a single opening 69 and passageway 66 may be provided. This arrangement will produce standing waves in an identical manner to the previous embodiment.

Figure 4:
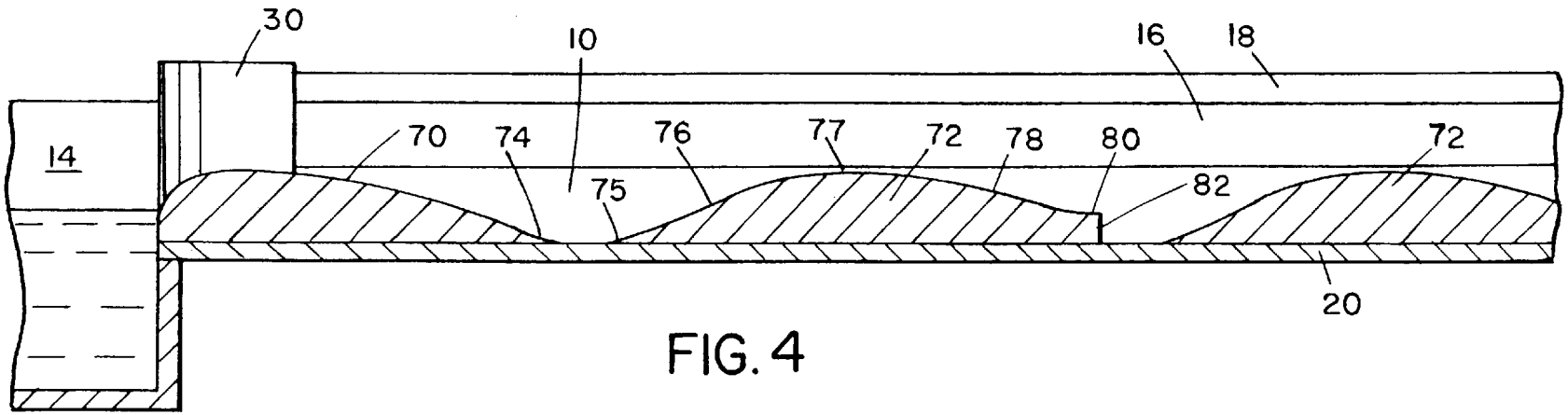
FIG. 4 is a sectional view similar to FIGS. 1 and 2 illustrating another embodiment of the wave forming apparatus.

FIG. 4 illustrates another modified embodiment, which has a similar solid weir and bed form arrangement to FIG. 3, but the secondary flow passageways are eliminated altogether. The structure in FIG. 4 is again identical to that of FIGS. 1 and 2, apart from the weir and bed forms, and like reference numerals are used for like parts as appropriate. In FIG. 4, a weir 70 is provided at the inlet end of channel 10 adjacent the reservoir outlet, and a series of spaced, solid bed forms 72 of identical shape are provided along channel 1 0 downstream of the weir. The weir 70 is of similar, airfoil shape to the weir 60 of FIG. 4, but rather than having an abrupt vertical cut off at the trailing edge, the trailing edge 74 of weir 70 continues to curve downwardly to meet the floor or base 20 of the channel at a smooth transition.

The bed forms 72 are of similar or identical shape to the bed forms 15 and 52 of the previous embodiments, with a leading edge 75 which has a flush transition with the base 20 of the channel, an upwardly inclined leading face 76, a peak 77, a downwardly inclined, concave trailing face 78, and a re-curved, substantially flat trailing end portion 80 with an abrupt vertical drop off face 82 at the trailing end of the bed form. It has been found that an abrupt drop off, such as vertical face 82 or the trailing end drop offs of FIGS. 2 and 3, helps to create a stable standing wave at the leading face of the next bed form. This effect will even occur without the secondary flow passageways, which is a simpler and less expensive structure, although it is less easily controllable and cannot be adjusted to produce different wave forms.

Figure 6:
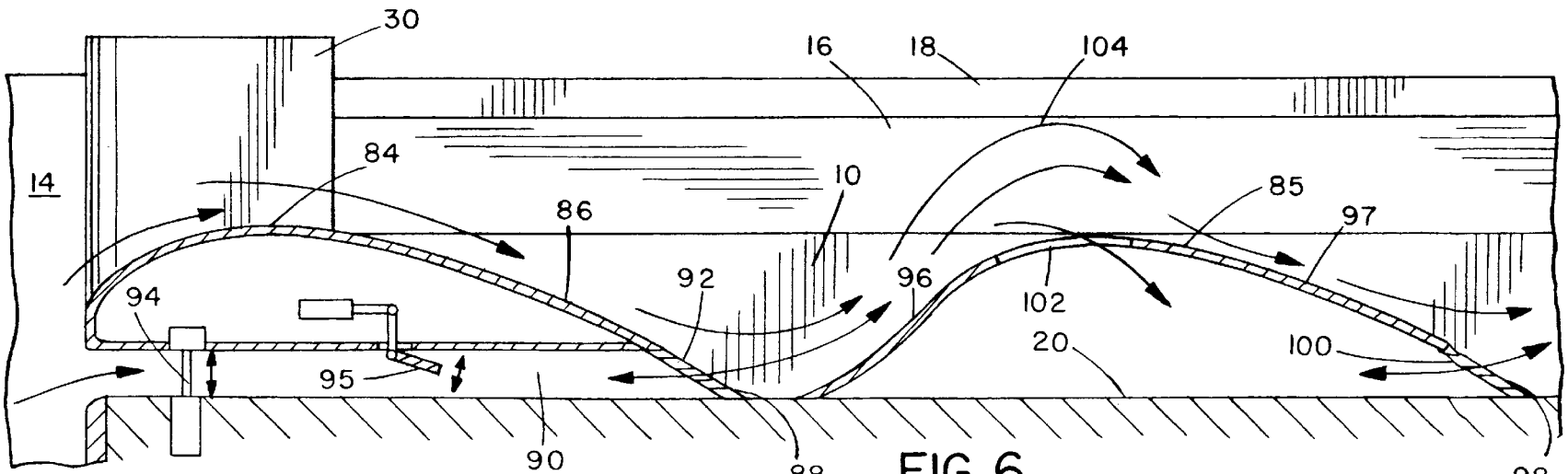
FIG. 6 is an enlarged sectional view similar to FIG. 2 illustrating another embodiment of the invention, with flow control mechanisms.

In the embodiments of FIGS. 1 to 5, the bed forms each have an abrupt trailing edge vertical drop off, with the trailing end of the bed form raised above the channel by a predetermined height, either with or without secondary flow paths for water through the bed form. FIG. 6 illustrates another alternative embodiment which has secondary water flow passageways, but no vertical drop off at the trailing edge of the weir or bed forms. Other parts of the wave forming apparatus are otherwise identical to the previous embodiments, and like reference numerals have been used as appropriate.

In the embodiment of FIG. 6, the channel 10 has a shaped weir 84 at the entry or reservoir end, and one or more bed forms 85 at spaced intervals downstream of weir 84. The weir and bed forms are of hollow shell construction, as in FIGS. 1 and 2, but may alternatively be of solid construction with formed passageways, as in FIG. 3. The weir is of generally airfoil like shape, and has a curved, convex trailing face 86 which extends down to merge smoothly with the base 20 of the channel at its trailing end 88. A secondary passageway 90 extends from reservoir 14 through the lower part of the weir up to the trailing end 88, with a safety grating 92 covering the open, trailing end of passageway 90. The passageway 90 may be provided with one or more flow control devices, such as height adjuster or hydraulic ram 94 and flap valve 95. The adjustable weir 84 of FIG. 6 may used in place of weir 12 of FIG. 2, or in any of the other embodiments to provide added adjustability of water flow at the leading end of the channel.

The bed form 85 has a shape similar to bed form 15 of FIG. 1, with a generally concave, upwardly inclined leading face 96 leading up to a peak, and a downwardly inclined, generally convex trailing face 97. However, the shape at the trailing end is different from the previous embodiments, since the trailing end cut off is eliminated, and the trailing face instead curves smoothly down to meet the base 20 of the channel at its trailing end 98. As in the previous embodiments, a secondary water flow passageway is provided through the bed form 85 via a vent opening 100 at the trailing end and vent openings 102 on opposite sides of the bed form which extend over the peak of the bed form. The vent openings will be covered with gratings for safety.

In this embodiment, the secondary passageway through the bed form, along with the shallow side portions 16 on opposite sides of the deeper channel containing the bed forms, and the shape of the bed forms, will tend to create a standing wave 104 at the first bed form 85 and each subsequent bed form in the channel, as in the previous embodiments. It will be understood that the weir and bed forms may alternatively be of solid construction with through passageways, as in FIG. 3.

Figure 7:
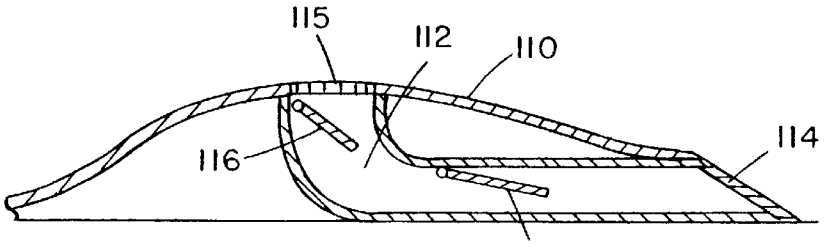
FIG. 7 is a sectional view of a single bed form forming part of a modified wave forming apparatus.

FIG. 7 illustrates an alternative bed form structure 110 which may be used in place of the bed forms 15 of the first embodiment. In this case, rather than permitting flow circulation in the entire area under the bed form, the flow is channeled through one or more passageways 112 via a vent or slot 114 at the trailing end of the bed form, and a vent or slot 115 adjacent the peak of the bed form. Each vent 114, 115 and the associated passageway 112 may extend across the width of the bed form, or two side slots may be provided as in FIGS. 1 and 2 to communicate via spaced passageways with a full width vent 115. Flow control flaps or valves 116 are provided in the passageway 112 to control the secondary flow, so that the size and stability of the subsequent standing wave can be controlled more readily.

Figure 10:
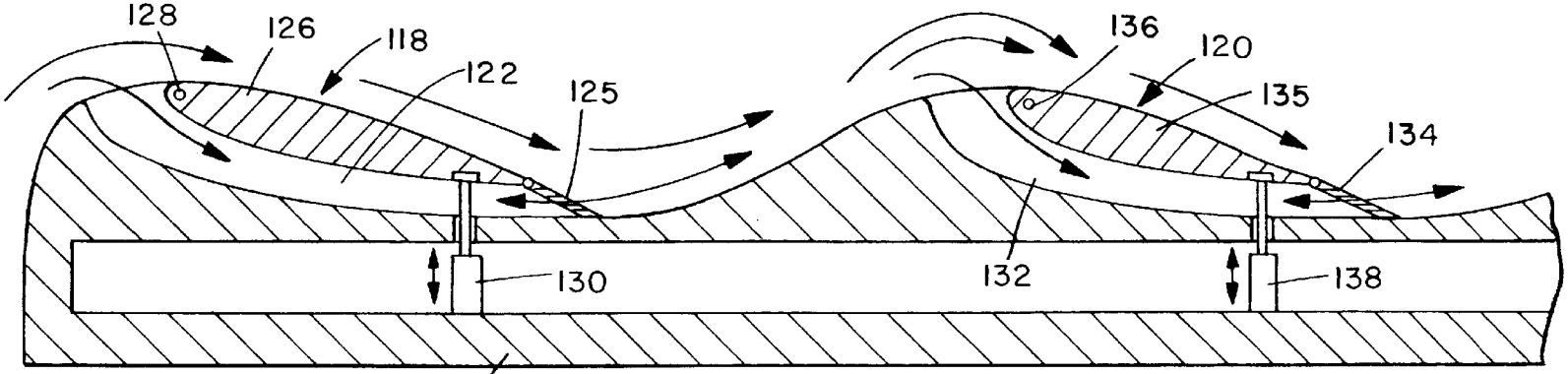
FIG. 10 is an enlarged sectional view similar to FIG. 6, illustrating another embodiment of the wave forming apparatus.

FIG. 10 illustrates a wave forming apparatus according to another embodiment of the invention, in which the weir 118 and bed forms 120 are actually molded into the base 121 of the channel, out of concrete or the like. The weir 118 has a passageway 122 extending from the leading end to a trailing end vent covered with a pivoted grating flap 125 which rests freely against the base 121. The upper portion 126 of the weir is pivoted at its leading end via pivot 128 and supported adjacent its trailing end by one or more hydraulic rams 130 spaced across the width of the passageway 122, acting between the base 121 and portion 126. Thus, the secondary flow rate can be readily adjusted simply by extending or retracting ram 130, either lifting the free end of portion 126 to increase the size of vent opening 124, or lowering portion 126 to reduce the vent size.

The bed form 120 is of similar shape to the previous embodiments, and has a secondary flow passageway 132 extending from a location adjacent the peak or highest point of the bed form to the trailing end of the bed form, wherein the vent is again covered with a pivoted grating flap 134 permitting height adjustment. An upper portion 135 of the bed form 120 is pivotally mounted at its leading end via pivot 136, and supported at its trailing end by one or more hydraulic rams 138 spaced across the width of the bed form, extending between base 121 and the portion 135. Again, this permits the size of the trailing end vent, and thus the amount of secondary flow in either direction through channel 132, to optimize the standing wave 139.

Figure 11:
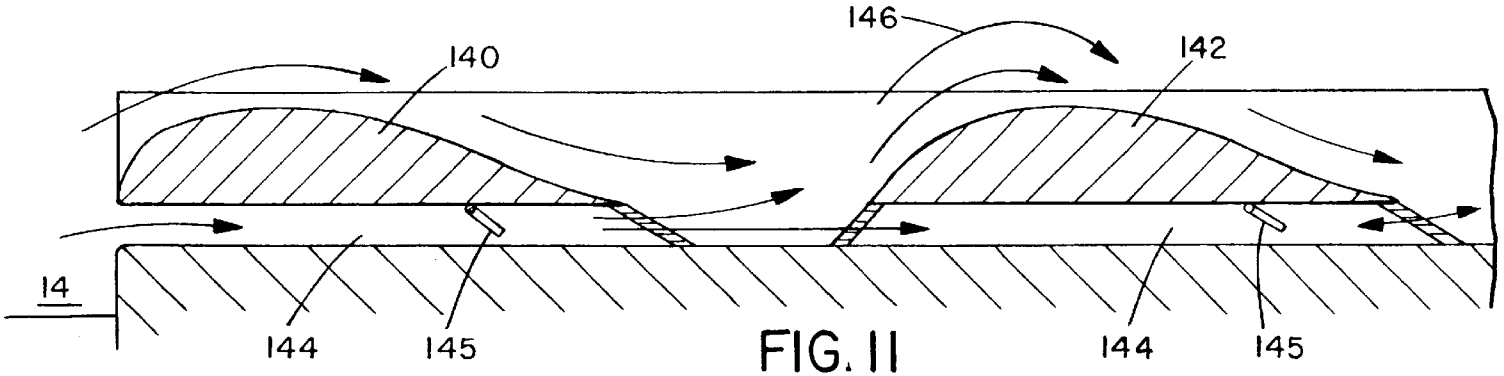
FIG. 11 is a view similar to FIG. 10 illustrating another embodiment of the invention.

FIG. 11 illustrates an alternative embodiment in which both the weir 140 and bed forms 142 have secondary flow passageways 144 extending from the leading end to the trailing end. Each passageway 144 has a flow control valve 145 for adjusting the amount of secondary water flow. The vent openings at each end of the bed form passageways, and the trailing end of the weir passageway, are covered with safety gratings. The bed forms are of similar shape to the previous embodiments, and will be mounted in an apparatus similar to that illustrated in FIGS. 1 and 2, with shallow side portions outside the channel containing bed forms 142. As in the previous embodiments, the arrangement is such that rideable standing waves 146 will form adjacent the peak of the first bed form 142 and each subsequent bed form.

Figure 12:
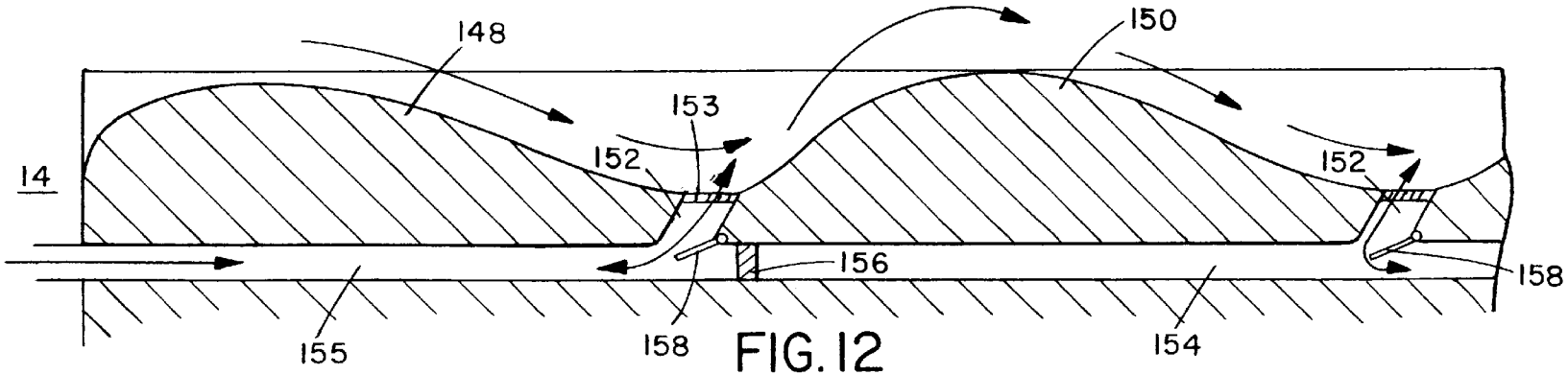
FIG. 12 is a view similar to FIGS. 10 and 11, illustrating another modified embodiment of the invention.

FIG. 12 illustrates another modification in which a weir 148 is followed by subsequent bed forms 150 of similar shape to the previous embodiments. However, in this case, rather than providing a secondary flow passageway extending from the peak or leading end of the bed form to the trailing end of the bed form, secondary water flow is instead provided via a vent passageway or opening 152 located between each adjacent pair of bed forms, and between the weir and first bed form.

The passageways 152 are each covered by a safety grating 153 at their open end and communicate with a single through passageway 154 extending through the base of the channel beneath the bed forms. A first portion 155 of the passageway beneath the weir is cut off from the subsequent portion of the passageway extending beneath the bed forms via wall 156. A flow control valve 158 is provided at the junction between each vent passageway 152 and the base passageway 152. This arrangement will also permit standing waves to form by permitting flow into and out of the area beneath the standing wave.

The embodiment of FIG. 12 will also be incorporated in an apparatus as generally illustrated in FIG. 1 with a central, deeper channel containing the weir and bed forms, and shallow side portions on each side of the channel. The valves 158 provide additional control for adjusting the properties of the standing waves formed over the bed forms.

Figure 14:
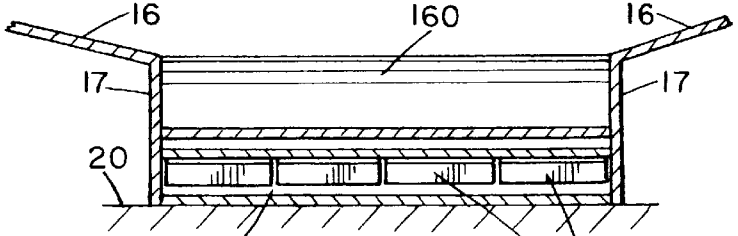
FIG. 14 is a sectional view on the lines 14—14 of FIG. 13.
Figure 13:
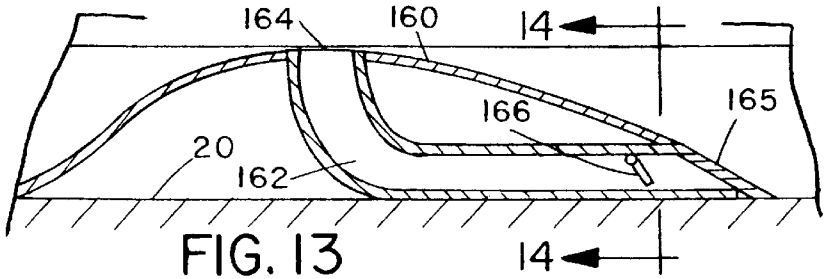
FIG. 13 is a view similar to FIG. 7, illustrating an alternative flow control.

FIGS. 13 and 14 illustrate another modified bed form 160 which may be used in place of the bed forms 15 of FIGS. 1 and 2 in a wave forming apparatus. The apparatus is otherwise identical to that of FIGS. 1, 32 and 5, and like reference numerals have been used for like parts as appropriate. In FIG. 13, the bed form is of similar shape to that of FIG. 6, although it may have a shape similar to that of FIG. 2, with a re-curved trailing end and a sharp vertical drop off. A secondary flow passageway 162 is provided from a vent opening or slot 164 at the peak of the bed form to a trailing end vent 165 covered by a grating. The trailing end vent 165 extends across the full width of the bed form, as indicated in FIG. 14.

A series of flap valves 166 are provided across the width of passageway 162 adjacent the trailing end vent opening. This allows the opening size to be varied across the width of the vent 165, to produce various effects in the subsequent standing wave formed downstream of bed form 160. For example, by closing the flaps 166 successively across the width of the vent 165, a sideways breaking wave may be produced. With all the flaps open, a stable standing wave is produced.

Figure 15:
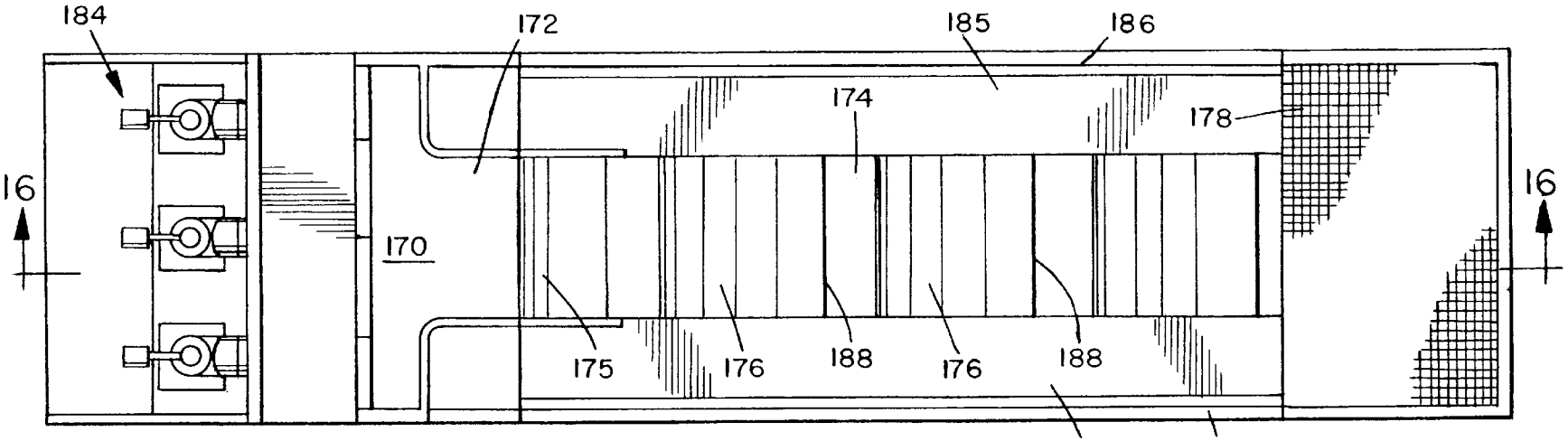
FIG. 15 is a top plan view of a wave forming apparatus according to another embodiment of the invention.
Figure 16:
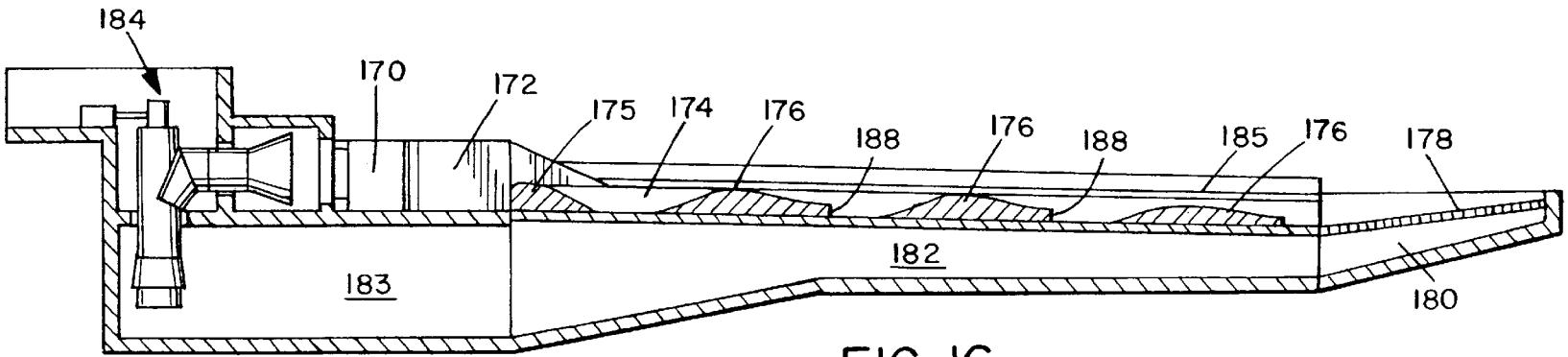
FIG. 16 is a sectional view on lines 16—16 of FIG. 15, illustrating the water re-circulation path.

FIGS. 15 and 16 illustrate a wave forming apparatus similar to that of FIGS. 1,2 and 5, but showing a possible water re-circulation system for circulating water back to a reservoir at the inlet end of the apparatus. In this embodiment, a raised reservoir 170 at one end of the apparatus supplies water via an elongated inlet 172 to a wave forming channel 174 in which a weir 175 and a series of spaced bed forms 176 are provided. At the end of channel 174, water falls through grating 178 into a chamber 180, and is then re-circulated through a passageway 182 beneath channel 174 back to a chamber 183 beneath the reservoir, where it is re-circulated via pumping system 184.

It will be understood that other water re-circulation systems may be used, such as passageways around the sides of channel 174, or the outlet end of the wave forming apparatus may be connected to other water rides, and water may then be re-circulated from those rides back to reservoir 170. As in the first embodiment, shallow side portions 185 extend from each side of channel 174 to the outer sides 186 of the apparatus, and this may be inclined slightly upwardly, as in FIG. 5, or may be flat or inclined slightly downwardly. The bed forms 176 of FIG. 16 are solid shaped members similar to those of FIG. 4, without any secondary flow passageways but with an abrupt vertical cut off 188 at the trailing end. However, bed forms 176 may be replaced with any of the other alternative bed forms illustrated in FIGS. 1 to 14. The sides of channel 174 are straight, rather than flaring outwardly as in FIG. 1. However, they may alternatively taper outwardly or inwardly from the leading end to the trailing end of the channel.

In this apparatus, as in the previous embodiments, standing waves will be formed downstream of each waveform 176 at the next structure, i.e. the upstream face of the next successive waveform, or, in the case of the last waveform, at the upwardly inclined grafting 178. The formation of a standing wave over grafting 178 has some advantages. For example, after exiting the wave, the rider can easily stand up in the shallow water over the grafting in order to exit the ride. In another alternative embodiment, a wave forming apparatus may comprise a channel as in the previous embodiments with a series of alternating waveforms and graftings, with each wave being formed over a grafting. This will separate the riders more effectively. Each successive waveform and grafting may be stepped down from the preceding pair, to ensure adequate water flow through the channel.

In each of the above embodiments, water flows over and through a weir at the inlet end of the channel. However, flow may alternatively be provided through side channels extending along opposite sides of the weir, under the control of flap valves.

The wave forming apparatus in each of the above embodiments will create a high quality, more readily controlled standing waves. A combination of features produces the optimum wave conditions, with some or all of these features being used dependent on the desired form of the standing wave, and what degree of adjustability in the wave formation is required. One key feature is a sequence of two or more shaped bed forms, such that waves will tend to be formed at a leading face of the successive bed forms. However, this alone is not sufficient to form a stable standing wave. Another key feature in forming a standing wave is the provision of secondary flow beneath each bed form, with a vent for flow into or out of the secondary passageway immediately upstream of the desired wave forming location, prior to the leading face of the next bed form. This is believed to provide flow out of or into the space beneath the wave at the wave forming location, enhancing the stability of the wave.

The opposite end of the secondary passageway is provided in most cases at or adjacent the peak or highest point of the bed form, and may comprise a vent across most of the width of the bed form, or two elongated side vents on opposite sides of the bed form centered at the peak. A further feature which produces improved standing waves is the provision of a sharp, vertical cut off at the trailing end of the bed form, so that a trailing end is spaced above the floor of the channel. This alone, without a secondary passage, will result in some standing wave formation. However, standing waves are enhanced by providing both a secondary passageway and a sharp cut off, as in some of the embodiments illustrated above. The secondary passageway also provides a convenient means for adjusting the standing wave, by means of height adjusters to vary the height of the trailing end of the waveform, valves to vary the secondary flow, and the like, as illustrated in some of the above embodiments. Adjustment of the size of the trailing end vent across the width of the bed form may be used to create a breaking, curling, or pitching wave. A surge of secondary flow can be created by hinging the bed form so as to first cut off the secondary flow, and then lifting the trailing end of the bed form. By providing a flexible trailing end portion for the bed form, which can lift and lower freely based on flow conditions, an oscillating wave form can be produced.

The bed form shape in each of the above embodiments comprises a concave leading face, a curved peak, and a convex trailing face. This tends to produce a wave at the leading face of the next bed form. In some of the above embodiments, the trailing face continues down to blend smoothly with the base of the channel. However, wave forming is enhanced by providing a re-curve adjacent the trailing end of the bed form, to produce a substantially horizontal tail portion before an abrupt vertical drop off at a predetermined tail elevation factor, or TEF, as illustrated in FIGS. 2 to 4, 7, 8, 11, 12, and 16. This will even produce standing waves without the secondary passageway for adding or removing water beneath the formed wave, although optimum effects and adjustability are provided by the combination of a secondary passageway and sharp drop-off.

The flume cross-sectional profile in each of the above embodiments comprises a deeper central channel containing the weir and bed forms for producing waves, and shallower side portions extending outwardly from opposite sides of the channel. This channels the water over the bed forms and prevents too much water from escaping around the bed forms, while allowing the sides of the top portion of each standing wave to vent sideways. This helps to prevent the wave from decaying and enhances stability. The shallow side portions may be tapered slightly upwardly so as to return water back to the center of the channel, although they may alternatively be horizontal or tapered downwardly.

The enhanced, stable, stationary wave formation of this invention may have applications outside the field of water amusement parks. For example, suitably shaped bed forms may be provided at the spillway of a dam. This would allow for standing wave creation which would spread energy more quietly and reduce the mist that is produced in standard dam spillways. In turn, this would reduce erosion. Another possible application would be as a water based arcade attraction, of the type using radio controlled boats or surfers. In this case, the apparatus would be made at around one quarter of the normal water ride scale. It may also be used in a stand-alone water toy.

Although some exemplary embodiments of the invention have been described above by way of example only, it will be understood by those skilled in the field that modifications may be made to the disclosed embodiments without departing from the scope of the invention, which is defined by the appended claims.

I claim:

1. A wave forming apparatus comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form;

a secondary flow passageway provided in the channel, the secondary flow passageway having a first end communicating with the primary water flow at a location adjacent the trailing end of the bed form, and a second end communicating with the primary water flow at a location upstream of the first end;

the trailing end of the bed form being spaced above the base of the channel to provide a vertical drop-off at the trailing end of the bed form, the trailing end being at a predetermined first height above the base of the channel; and wherein there are at least two spaced bed forms in the channel and the upper portion of the second bed form is at a predetermined second height above the base of the channel, and the trailing end and upper portion together define a predetermined tail elevation factor (TEF) comprising a ratio of the first height to the second height.

2. The apparatus as claimed in claim 1, wherein the upstream face of the bed form is concave and the downstream face is convex.

3. The apparatus as claimed in claim 1, wherein the first end of the secondary flow passageway comprises a first vent extending across the width of the bed form.

4. The apparatus as claimed in claim 1, wherein the second end of the secondary flow passageway is located at the upper portion of the bed form.

5. The apparatus as claimed in claim 1, wherein the second end of the secondary flow passageway comprises a vent extending across the full width of the bed form.

6. The apparatus as claimed in claim 1, wherein the second end of the secondary flow passageway comprises spaced vents adjacent opposite sides of the bed form.

7. The apparatus as claimed in claim 6, wherein each vent extends across the upper portion of the bed form in the primary flow direction.

8. The apparatus as claimed in claim 1, wherein the bed forms are of solid construction and the secondary flow passageway extends through each bed form.

9. The apparatus as claimed in claim 1, wherein the bed form comprises an outer shell and a hollow interior, the outer shell having openings for secondary flow and the secondary flow passageway comprising the hollow interior of the bed form.

10. The apparatus as claimed in claim 1, wherein the bed form comprises an outer shell and a hollow interior, the outer shell having openings for secondary flow and the secondary flow passageway comprising a duct extending through the bed form and connecting the openings.

11. The apparatus as claimed in claim 1, comprising a flume having a first end, a second end, and outer sides, the channel containing the weir and bed forms extending along a central portion of the flume from the first end to the second end, and the flume having side portions on opposite sides of the channel extending from the respective channel side wall out to the opposite sides of the flume, the side portions of the flume being shallower than the channel.

12. The apparatus as claimed in claim 11, wherein each side portion is tapered upwardly from the channel side wall to the outer side of the flume.

13. The apparatus as claimed in claim 12, wherein each side portion is tapered at an angle of between 0° to 10° to the horizontal.

14. The apparatus as claimed in claim 11, wherein each side portion has a width equal to at least 33% of the channel width.

15. The apparatus as claimed in claim 11, wherein each side portion is oriented at an angle of between −5° to +10° relative to the horizontal direction outwardly from the side wall of the channel.

16. The apparatus as claimed in claim 11, wherein the outer side portions of the flume comprise ride entry and exit portions.

17. The apparatus as claimed in claim 1, including at least one valve in each secondary flow passageway for adjusting flow rate through the passageway.

18. The apparatus as claimed in claim 17, wherein the first end of the secondary flow passageway comprises a vent extending across at least a major portion of the width of the bed form, and a series of valves are provided across the width of the vent for adjusting the secondary flow across the width of the bed form, whereby the properties of the standing wave can be varied.

19. The apparatus as claimed in claim 1, wherein the bed form comprises a hollow shell and at least one pedestal is provided inside the shell extending between the base of the channel and the upper portion of the bed form.

20. The apparatus as claimed in claim 19, wherein the bed form is adjustably mounted and the pedestal is adjustable in height to vary the bed form height.

21. The apparatus as claimed in claim 19, wherein the bed form is formed of flexible material, the leading end of the bed form is secured in the base of the channel, and the trailing end of the bed form is free, and a second pedestal is provided adjacent the trailing end for supporting the trailing end above the base, the second pedestal being adjustable in height to vary the spacing of the trailing end above the base defining a first vent opening at the first end of the secondary flow passageway.

22. The apparatus as claimed in claim 21, wherein a series of second pedestals are provided across the width of the trailing end of the bed form, the second pedestals being independently adjusted whereby the size of the vent opening may be varied across the width of the bed form.

23. The apparatus as claimed in claim 1, including a grating downstream of the bedform, the channel having a chamber underneath the grating for re-circulation of water, whereby a standing wave is formed over the grating.

24. The apparatus as claimed in claim 23, wherein the grating is inclined upwardly in the water flow direction.

25. The apparatus as claimed in claim 1, wherein the tail elevation factor is in the range from 0.125 to 0.75.

26. The apparatus as claimed in claim 1, wherein the tail elevation factor is variable across the width of the channel.

27. The apparatus as claimed in claim 1, wherein the trailing end of the bed form is not secured to the base of the channel and is free to oscillate with changes in water pressure to produce an oscillating wave.

28. The apparatus as claimed in claim 1, wherein a series of identical bed forms are provided at spaced intervals along the channel, whereby a series of standing waves are formed.

29. The apparatus as claimed in claim 1, wherein the channel has an outlet end spaced from the inlet end, and the side walls of the channel taper outwardly from the inlet end to the outlet end, whereby the channel is of variable width along its length.

30. The apparatus as claimed in claim 1, wherein the channel has an outlet end spaced from the inlet end, and the side walls of the channel extend in a straight line from the inlet end to the outlet end.

31. The apparatus as claimed in claim 1, wherein the leading edge of the bedform is flush with the base of the channel.

32. A wave forming apparatus comprising:

a channel for containing a flow of water, the channel having an inlet end connected to a water supply, a base, and spaced side walls, a weir in the base at the inlet end of the channel, and at least one bed form in the channel downstream of the weir;

the bed form having a leading end and a trailing end, an upwardly inclined upstream face extending downstream of the leading end, an upper portion, and a downwardly inclined downstream face extending from the upper portion to the trailing end, the weir and bed form each extending outwardly to the side walls to define a primary water flow path from the inlet over the weir and bed form; and the trailing end of the bed form being spaced above the base of the channel to define an abrupt vertical drop-off of predetermined height; and a second bed form being provided in the channel downstream of the first mentioned bed form, the upper portion of the second bed from is at a predetermined second height above the base of the channel, and the ratio of the height of the tail end of the bed from to the second height comprises a predetermined tail elevation factor.

33. The apparatus as claimed in claim 32, wherein the abrupt vertical drop-off comprises a vertical end face of the bed form.

34. The apparatus as claimed in claim 32, wherein the trailing end of the bedform is supported at a spacing above the base of the channel, the spacing comprising a first vent, and a secondary flow passageway extends from the first vent through the bed form, a second vent being provided in the bed form upstream of the first vent and communicating with the secondary flow passageway.

35. The apparatus as claimed in claim 32, wherein the tail elevation factor is in the range from 0.125 to 0.75.

36. The apparatus as claimed in claim 32, wherein the bed form has a leading face and a trailing face, the leading face of the bed form is of generally concave shape, and the trailing face has a first, convex portion extending from the upper portion, and re-curves into a generally flat portion adjacent the tail end of the bed form.

37. The apparatus as claimed in claim 32, wherein the leading end of the bedform is flush with base of the channel.

* * * * *